United States Patent [19]

Dufau

[11] Patent Number: 4,760,612

[45] Date of Patent: Aug. 2, 1988

[54] AIR REGULATED CLEANER DISCHARGE DEVICE FOR TOILETS AND THE LIKE

[75] Inventor: Oscar R. Dufau, Fullerton, Calif.

[73] Assignee: Fluidmaster, Inc., Anaheim, Calif.

[21] Appl. No.: 42,580

[22] Filed: Apr. 22, 1987

Related U.S. Application Data

[63] Continuation of Ser. No. 842,116, Mar. 20, 1986, abandoned.

[51] Int. Cl.[4] ..... E03D 9/02

[52] U.S. Cl. ..... 4/225; 137/205.5; 222/57; 422/292; 4/228

[58] Field of Search ..... 4/222-225, 4/228, 227, 431-433; 137/205.5, 138, 144, 147, 564.5; 222/251, 57, 61, 62; 422/292-296

[56] References Cited

U.S. PATENT DOCUMENTS

| | | | |
|---|---|---|---|
| 1,291,428 | 1/1919 | Currie . | |
| 2,479,842 | 8/1949 | Kirwan . | |
| 2,993,214 | 7/1961 | Franco . | |
| 3,890,657 | 6/1975 | Gray . | |
| 4,229,410 | 10/1980 | Kosti | 4/224 |
| 4,319,369 | 3/1982 | Lippincott, Sr. . | |
| 4,429,423 | 2/1984 | Syrenne | 4/225 |

OTHER PUBLICATIONS

Article from *Cleaning Management*, pp. 28-30, Circa 1980.

Article in New York, *Daily News*, Dec. 23, 1980.

*Primary Examiner*—Henry J. Recla

*Assistant Examiner*—L. J. Peters

*Attorney, Agent, or Firm*—Freilich, Hornbaker, Rosen & Fernandez

[57] ABSTRACT

An air regulated cleaner discharge device is for use in a toilet water tank, the tank having a ballcock for discharging water to fill the tank from a minimum water level to a maximum water level, a flush valve connected to a toilet bowl for flushing water therein from the tank, and an overflow pipe projecting above the maximum water level having a ballcock refill tube connected thereto for directing tank water to refill the toilet bowl after flushing. The novel device has a preferably plastic container for receiving a mixture of liquid or other chemical material therein with an air supply tube having an inlet end opening into the tank spaced above the minimum water level and below the maximum water level, and an outlet end opening into the container preferably at an extreme upper portion above the minimum water level. A liquid cleaner supply tube also preferably of plastic is connected into the container at preferably an extreme lower end portion thereof and particularly below the air supply tube outlet end. Finally, low pressure liquid flow, preferably a venturi, connects the liquid cleaner supply tube into the ballcock refill tube for creating a low pressure acting upon the liquid cleaner in the container and in the liquid cleaner supply tube to thereby flow the liquid cleaner into the refill tube as long as refill tank water is flowing in the refill tube and air is flowing into the container air supply tube inlet. The liquid cleaner flow ceasing when the flow of air ceases into the container air supply tube.

10 Claims, 2 Drawing Sheets

AIR REGULATED CLEANER DISCHARGE DEVICE FOR TOILETS AND THE LIKE

This application is a continuation of application Ser. No. 842,116 filed Mar. 20, 1986, now abandoned.

BACKGROUND OF THE INVENTION

This invention relates to an air regulated cleaner discharge device for toilets and the like, and more particularly, to such a device for adding a determined measured amount of liquid cleaner to each quantity of water during each toilet flush. The added quantity of liquid cleaner is adaptable, not only for cleaning and disinfecting the particular water during and after each flush, but the same can also, if desired, have various quantities of various other materials added thereto for other purposes, for instance, for deodorizing. Furthermore, the air regulated cleaner discharge device has the distinct advantage of mixing the particular cleaner, and other materials as desired, with the toilet bowl water directly within the toilet bowl and on an automatic basis rather than requiring, as has been true in many applications, the mixture of a large and cumbersome amount of cleaner additative to the entire toilet water tank.

Various types and sizes of chemical packages and chemical holding containers dealing with both solid and liquid forms thereof have heretofore been provided over the period of years. Furthermore, these prior chemicals have dealt primarily with the adding of the same to the relatively large toilet water tanks. These have not been totally satisfactory for many reasons, not the least of which is the having to deal with the relatively large toilet water tank when the chemicals are really required within the toilet bowl.

As an example, the cleaning chemicals have been provided in a water soluble, solid form. The solid form of chemical is suspended beneath the normal water level within the toilet water tank and the degree of solubility of the chemical is depended upon to dissolve the same and circulate it throughout the relatively large toilet water tank. Thus, when there is a water flush, the dissolved chemical is carried with the normal flushing water directly into the toilet bowl. In addition, since the chemical is circulated within the entire flushing water, a very large portion thereof is flushed directly through the toilet bowl and this is true of any chemical, a cleaner or otherwise, which is dissolved in the toilet water tank.

Another form of chemical emitting device which has previously been used makes use of a plastic container which holds an amount of chemical therein and has particular size openings to permit a certain amount of the chemical to be released from the plastic container during every circulation of water. The particular plastic container is fabricated for being positioned resting on the bottom wall of the toilet water tank, or suspended at an intermediate location on one of the side walls of the toilet water tank. More important, since these devices discharge a given quantity of the chemical every time the liquid in the toilet water tank is circulated, this means that the given quantity of chemical will be discharged during each flush as determined by this water movement. Various different forms of valves have been provided for the plastic container in order to assure the proper release of the chemical, but at best, these cannot be very accurate and, again, we are still dealing here with the relatively large quantity of water in the toilet water tank which must ultimately circulate into the toilet bowl rather than placing the chemical additive solely within the bowl where it is primarily needed.

In an effort to overcome this deficiency, various complicated valves and other mechanical mechanisms have been provided in combination with particular forms of devices which add the chemical additive for cleaning, disinfecting and deodorizing directly into the toilet bowl or directly into the charge of water for refilling the toilet bowl. This, of course elminates the objection to the relatively large toilet water tank and the attempt to add chemicals therein with only a portion having the opportunity to act against the contaminants within the toilet bowl. Probably the most severe fault of these various forms of prior valves and other mechanisms has been the complicated nature thereof and the expense required for providing the same. Furthermore, even where provided, these prior devices are not truly properly adjustable and require the constant care of a trained technician.

OBJECTS AND SUMMARY OF THE INVENTION

It is, therefore, an object of this invention to provide an air regulated cleaner discharge device for toilets and the like which is of a maximum simplicity, yet it is of a maximum positive use and without the requirement for tedious regulation. With the use of the cleaner discharge device of the present invention, in addition to the standard equipment within the toilet water tank which normally includes the ballcock, the flush valve, the overflow pipe, and the ballcock refill tube directed into the overflow pipe, the present invention only requires a particularly formed container with an air supply inlet tube, a liquid cleaner supply tube between the container and the refill tube, and a particularly formed discharge device at the refill tube. Furthermore, the air regulated cleaner discharge device, once assembled in the toilet tank, operates completely automatically, with the exception of requiring replenishment of the liquid cleaner when it becomes exhausted. The cleaner discharge device operates totally automatically every time the toilet is flushed and serves to add the desired liquid cleaner and other chemical treatment, if desired, directly into the toilet bowl for functioning exactly as contemplated.

It is a further object of this invention to provide an air regulated cleaner discharge device for toilets and the like which satisfies the foregoing object, yet makes use of relatively standard equipment in a quite novel combination including a low pressure creating liquid flow means or device. The low pressure creating device is preferably a venturi installed at the outlet of the usual refill tube as the refill tube is directing toilet bowl refill water into the usual overflow pipe. This preferred venturi is arranged so that the cleaner liquid is drawn thereby from a separate container as actuated every time the toilet is flushed, the liquid cleaner being mixed with the usual supply of refill water which is dispensed in addition to the normal flushing water by every modern toilet. Thus, the refill water, having the liquid cleaner mixed therein takes its usual path of travel directly into the toilet bowl to not only refill the toilet bowl with water, but also to cause the same to be additionaly cleaned and possibly otherwise treated, all as originally contemplated.

It is still an additional object of this invention to provide an air regulated cleaner discharge device for toilets and the like which satisfies either or both of the foregoing objects in a simple and efficient manner, but also makes it possible to provide a cleaner discharge device which makes use of a unique form of container which operates as fully intended in a positive manner. The novel container is of an exceedingly quite simple form and is economical to manufacture from relatively cheap, modern day materials. For instance, if desired, the container is initially molded from modern molding equipment and may have the inlet air supply tube molded directly thereon providing a relatively cheap and efficient package. Furthermore, the liquid cleaner supply tube between the container and the refill tube may be formed of usual liquid transmitting tube materials, thereby adding relatively low cost to the container package.

Other objects and advantages of the invention will be apparent from the following specification and the accompanying drawings which are for the purpose of illustration only.

DESCRIPTION OF THE BEST EMBODIMENT CONTEMPLATED

The principles of the present invention deal with an air regulated cleaner discharge device which is used in combination with a standard form of toilet or the like. The basic purpose of such a cleaner discharge device is the selected addition of chemicals and other materials to the toilet flushing water for added cleaning, disinfecting, deodorizing and any other intended purpose, any one or all. Thus, in the following specification and claims, when "cleaner" or "cleaning" is used, it is intended to refer to the various singular or plural additives that might be used. Furthermore, the various standard elements of the toilet flushing mechanism is given as an example to which the air regulated cleaner discharge device may be added and it is not intended to limit the principles of the present invention by the particular equipment shown.

Figure 1:
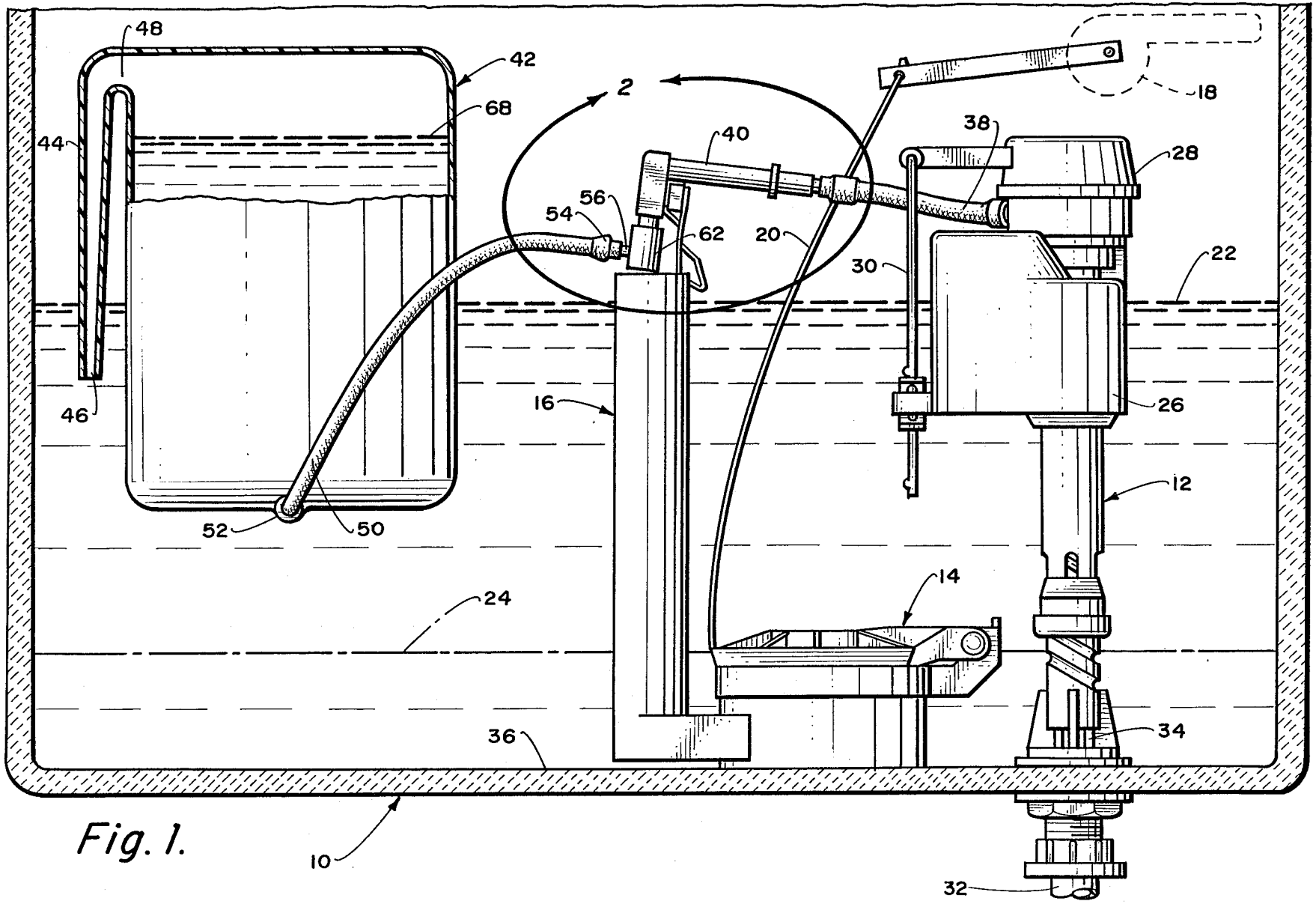
FIG. 1 is a side elevational view of a toilet water tank with the assembly of a ballcock, a flush valve and an overflow pipe arranged therein, and added thereto the assembly of a preferred embodiment of the air regulated cleaner discharge device of the present invention, the toilet water tank being shown in vertical section.

Referring initially to FIG. 1, the standard water flushing equipment of the particular toilet includes an upwardly opening toilet water tank generally indicated at 10 which serves to mount a ballcock generally indicated at 12, a flush valve generally indicated at 14 and an overflow pipe generally indicated at 16. The flush valve 14 is opened by pivoting a valve actuator 18 applying tension to the strap 20 with the valve remaining open, normally by trapping air, until the flushing water drains downwardly from a maximum water level 22 to a minimum water level 24, the latter being approximately at the flush valve 14. During the flushing water drainage, the downward movement of the flushing water level lowers a ballcock float 26 which pivots a ballcock valve 28 through levers 30 to open the ballcock 12 into a main water supply line 32 and cause a main water supply to pass upwardly in the ballcock centrally thereof, through the ballcock valve 28 and downwardly at an outer portion of the ballcock 12 finally exiting into the toilet water tank 10 at ballcock flow outlet 34 very near a tank bottom wall 36.

The flushing water in the toilet water tank 10 drains downwardly through the flush valve 14 and through the toilet (not shown) until the flush valve closes, the flushing water having reached the minimum water level 24. At this point, with the ballcock valve 28 remaining open, the flushing water builds upwardly toward the maximum water level 22 ultimately moving the ballcock float 26 upwardly to close the ballcock valve 28 to cease the water flow from the main water supply line 32. During the entire time that the main flushing water is directed through the ballcock 12 to aid in the final flushing and ultimately to refill the toilet water tank 10 to its maximum water level 22, a smaller portion of such flushing water is directed by the ballcock valve 28 into a ballcock refill tube 38 where it passes through the refill tube nozzle 40 into the upper end of the overflow pipe 16 ultimately flowing downwardly therein and around the flush valve 14 which has no control thereon and ultimately into the toilet bowl (not shown) for refilling the same with a particular amount of water.

Still referring for the moment to FIG. 1, a preferred embodiment of the air regulated cleaner discharge device making up the principles of the present invention in combination with the foregoing includes a container 42 which may be molded from plastic and has molded thereon an air supply tube 44. The air supply tube 44 includes a lower inlet end 46 opening into the toilet water tank 10 slightly below the maximum water level 22 quite widely spaced from the minimum water level 24, and an outlet end 48 opening into the container 42 spaced above the maximum water level 22 preferably at the upper extremity of the container. A liquid cleaner supply tube 50 is connected between the container 42 and the ballcock refill tube 38, a tube inlet end 52 being connected to the lower portion, preferably at the lower extremity, of the container 42 and a tube outlet end 54 connected into the lower extremity of the refill tube nozzle 40.

It will be noted that the air and liquid passages through the container 42, the air supply tube 44 and the liquid cleaner supply tube 50 into the lower portion of the refill tube nozzle 40 are preferably air tight and liquid tight from the inlet end 46 of the air supply tube 44 to the refill tube nozzle 40. This is required to insure operability of the air regulated cleaner discharge device of the present invention as will be discussed below. Furthermore, the container 42 may be secured to the toilet water tank 10 in any usual manner, again to be hereinafter discussed.

Figure 2:
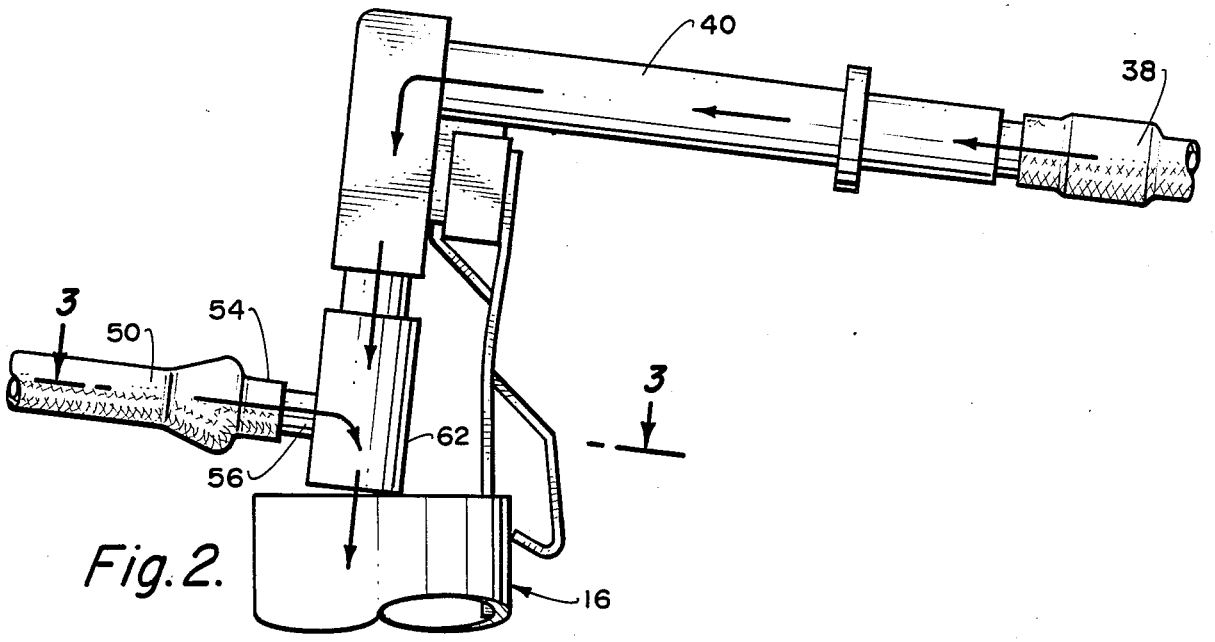
FIG. 2 is an enlarged, fragmentary side elevation of an end portion of the refill tube having an end portion of the cleaner discharge device thereon all mounted at the shown upper part of the overflow pipe.
Figure 3:
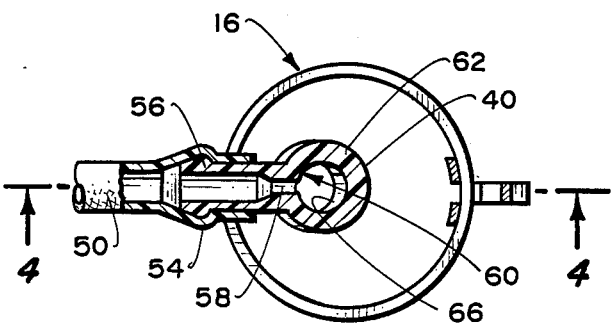
FIG. 3 is a horizontal sectional view looking in the direction of the arrows 3—3 in FIG. 2.
Figure 4:
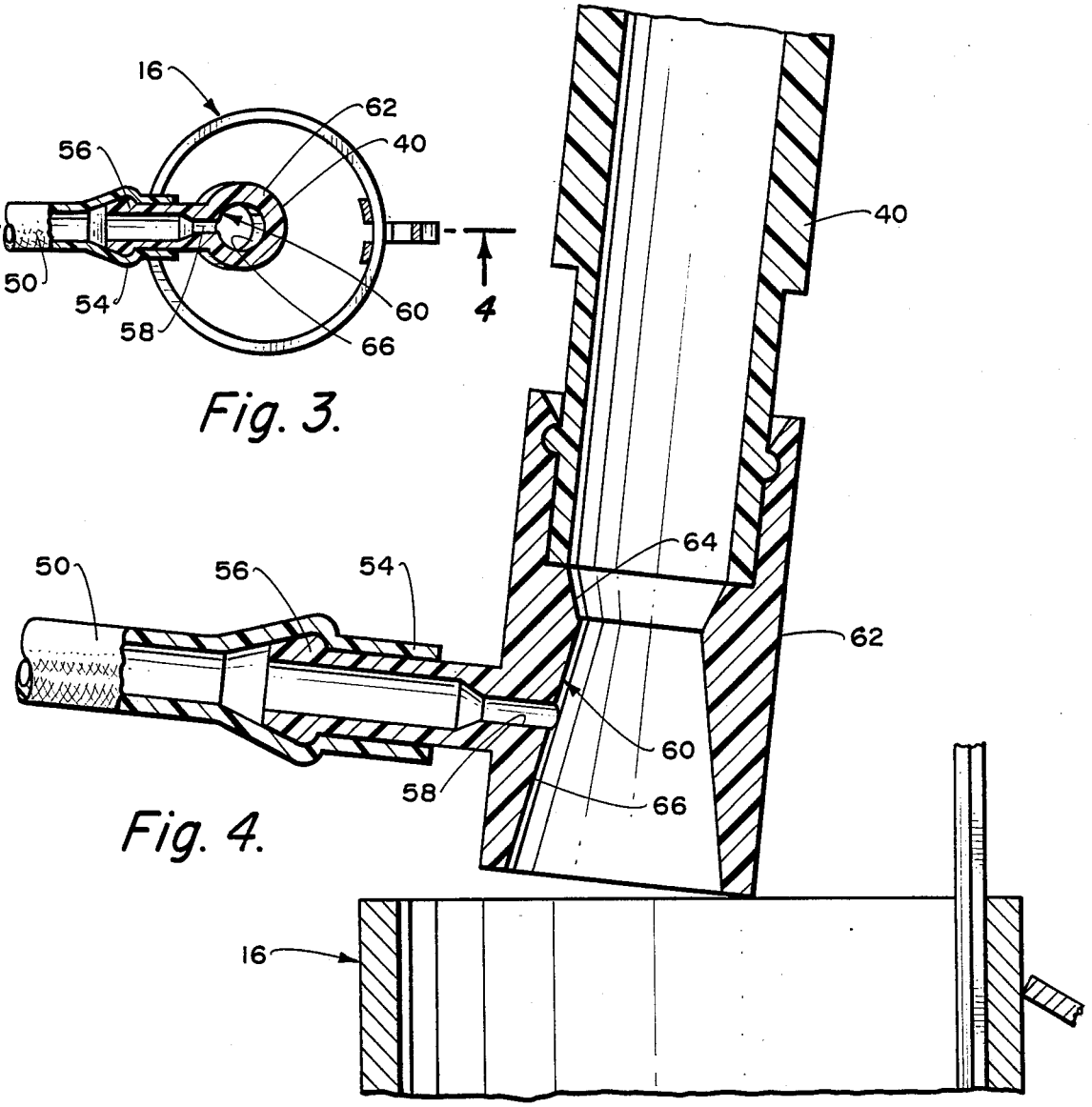
FIG. 4 is an enlarged, vertical sectional view looking in the direction of the arrows 4—4 in FIG. 3.

As shown particularly in FIGS. 2, 3 and 4, the oulet end 54 of the liquid cleaner supply tube 50 connects through an inlet nipple 56 to a determined diameter, venturi inlet nozzle 58 which opens into a venturi 60 formed in a venturi casing 62 secured to the lower end of the refill tube nozzle 40, all as particularly seen in enlarged view in FIG. 4. The venturi 60 has a decreasing angle 64 leading from the lower extremities of the refill tube nozzle 40 and then an increasing angle 66 from the decreasing angle to the lower end thereof so that a decreasing pressure liquid flow area is formed at the lower increasing angle 66 where the venturi inlet nozzle 58 is connected. The venturi inlet nozzle 58 and the venturi 60 may be formed of the desired angles for the low pressure result desired, the basic purpose thereof being to create a liquid flow low pressure area which will cause the necessary low pressure area for drawing liquids from the container 42 when the air supply tube 44 is opened to the air and the normal liquid, the refill water, is flowing from the ballcock 12 downwardly through the refill tube nozzle 40 and the venturi 60 into the overflow pipe 16. The assembly is, therefore, completed by filling the container 42 so as to hold a sufficiency of liquid cleaner 68 as shown in FIG. 1.

In operation of the air regulated cleaner discharge device in the particular embodiment shown, the toilet flushing equipment operates in its usual manner. Starting with the toilet water tank 10 at its maximum water level 22 as shown in FIG. 1 awaiting a flushing action and with the container 42 of the cleaner discharge device filled with a sufficiency of liquid cleaner 68 as shown, the flushing action is started by actuating the valve actuator 18 which through the strap 20 opens the flush valve 14. The flush valve 14 remains open during the main flushing action, as before stated, usually by air or other predicated means well known in the art.

Immediately upon the opening of the flush valve 14, the flush water in the toilet water tank 10 begins to flow downwardly therethrough and through the toilet bowl for creating the flushing action. The flushing water in the toilet water tank 10 decreases in water level from the maximum water level 22 downwardly toward the minimum water level 24. Furthermore, as the water level decreases, the ballcock float 26 is carried therewith, this initially maintaining the ballcock valve 28 closed. After the ballcock float 26 has moved downwardly with the decreasing water level, it actuates the ballcock valve 28 to turn on the water supply in the main water supply line 32 so that the main water supply exits the ballcock 12 at the ballcock float outlets 34.

This flushing action of the main flushing water downwardly through the flush valve 14 and a certain amount of added flushing water entering through the ballcock 12 continues as the water level moves toward the minimum water level 24. In addition, starting immediately upon the ballcock 12 being opened by the ballcock float 26, a relatively small amount of the flushing water entering through the ballcock 12 is automatically directed off through the ballcock refill tube 38 flowing through the refill tube nozzle 40, passing downwardly through the venturi casing 62 into the overflow pipe 16 and ultimately flowing into the toilet bowl (not shown). Still further, once the main flushing water level in the toilet water tank 10 passes sufficiently downwardly exposing the lower opened end or inlet end 46 of the container 42, the flushing water flow from the refill tube nozzle 40 and through the venturi casing 62 is provided with a low pressure area as a result of the water flow through the venturi 60. This creation of the low pressure draws liquid cleaner 68 from the container 42 through the venturi 60 and mixes it with the flushing water flowing therethrough so that this liquid cleaner is mixed with the flushing water and carried downwardly into the toilet bowl.

All of this flushing action continues until the flushing water level in the toilet water tank 10 reaches the minimum water level 24 when the flush valve 14 automatically closes stopping the main flushing water from flowing downwardly into the toilet bowl and permitting the ballcock 12 to begin to refill the toilet water tank 10 with the water from the main water supply line 32. Although the main flushing water flow now ceases, the refill water flow portion of the flushing water continues through the ballcock refill tube 38 causing a determined amount of water to exit the refill tube nozzle 40 and venturi casing 62 into the overflow pipe 16 and ultimately into the toilet bowl, this carrying with it a determined amount of liquid cleaner 68 as drawn from the container 42 by the venturi 60. Thus, the toilet bowl is begun to be refilled by the normal action of the ballcock refill tube 38 and is also begun to be provided with a certain amount of liquid cleaner 68 as drawn from the container 42. Thus dual action continues until the flushing water level reaches and covers the inlet end 46 of the air supply tube 44 on the container 42.

This cuts off the drawing of liquid cleaner 68 from the container 42 since air circulation into the container by the air supply tube 44 is prevented and it is impossible for the venturi 60 to draw the liquid cleaner from the container. However, the flushing water flow into the toilet water tank 10 for refilling the same and the refill water flow through the ballcock refill tube 38 and into the toilet bowl continues until the maximum water level 24 is reached. During the latter stages of this flushing water flow from the ballcock 12 it carries the ballcock float 26 therewith so that when the maximum water level 24 is reached, the ballcock 12 closes cutting off the flow of water from the main water supply line 32 and returning everything to the position shown in FIG. 1.

It can be seen, therefore, that not only is there a normal flushing action taking place with the toilet bowl equipment, but also added to the refill water of the toilet bowl is a liquid cleaner for cleaning and otherwise treating this refill water within the toilet bowl. It is important to note that this liquid cleaner treatment of the flushing water is directly in the toilet bowl and is not required within the much larger toilet water tank. Furthermore, this adding of the liquid cleaner is totally automatic merely based on the normal flushing of the toilet flushing equipment.

As hereinbefore pointed out, applicants' use of the term "liquid cleaner" is not intended to limit the added material to cleaners alone or other materials alone, this being used as a generic term encompassing all types of cleaners, disinfectants, deodorants and the like, any one or all. Furthermore, these may be solely in liquid form when added to the container 42 or may be in solid soluable form when added with water being added to eventually arrive at the required liquid state. The container 42 also could be provided as a replacement container or could be a permanent container with a refill opening which would ultimately be required to air-tight seal during the operation of the same.

Finally, the present preferred embodiment of the air regulated cleaner discharge device has been shown using the venturi 60 for creating the low pressure area within the venturi casing 62 to draw the liquid cleaner 68 from the container 42. This, however, could be altered and other low pressure creating devices used without altering the principles of the present invention. The important thing is that according to the present invention, liquid cleaner 68 is drawn from the container 42 totally as air regulated for providing the ultimate additive in the toilet bowl.

Although the principles of the present invention have been herein illustrated in a particular embodiment of air regulated cleaner discharge device for use with toilets and the like, it is not intended to limit such principles to that construction alone, since the same principles are readily applicable to various other forms of cleaner discharge device. Thus, the principles of the present invention should be broadly construed and not limited beyond the specific limitations set forth in the appended claims including the patent equivalents thereof.

I claim:

1. In an air regulated cleaner discharge device of the type which comprises a toilet water tank, the water tank having a ballcock for discharging water to fill the tank from a minimum water level to a maximum water level, a flush valve connected to a toilet bowl for flushing water therein from the tank, and an overflow pipe projecting above the maximum water level having a ballcock refill tube connected thereto for directing water to refill the toilet bowl after said flushing; the cleaner discharge device in combination therewith including a container in said water tank for receiving a concentrated liquid cleaner that is corrosive to the components inside of the water tank, including the flush valve or ballcock, therein; an air supply tube having an inlet end opening into said tank and spaced above said minimum water level and below said maximum water level and an outlet end opening into said container at an upper portion thereof, a portion of the length of said air supply tube spaced from said inlet end thereof being above said maximum water level preventing the water in the tank from mixing with the concentrated liquid cleaner; a liquid cleaner supply tube connected into said container at a lower portion thereof spaced below said air supply tube outlet end; said air supply tube from said inlet end thereof and through said container and through said liquid cleaner supply tube all being essentially air tight; liquid flow means operably connecting said liquid cleaner supply tube into said ballcock refill tube for creating a low pressure acting upon said liquid cleaner in said container and in said liquid cleaner supply tube to thereby flow said liquid cleaner into said refill tube as long as water is flowing in said refill tube and air is flowing into said container air supply tube inlet end, said liquid cleaner flow into said refill tube being prevented when the water level in said tank is at a level between a point above said container air supply tube inlet and said maximum water level, preventing the flow of air into said container air supply tube inlet.

2. In an air regulated cleaner discharge device as defined in claim 1 in which said outlet end of said air supply tube is connected opening into said container near the upper extremity thereof with said inlet end extending downwardly and spaced above said minimum water level.

3. In an air regulated cleaner discharge device as defined in claim 1 in which said inlet end of said air supply tube opens into said tank spaced just slightly below said maximum water level of said tank.

4. In an air regulated cleaner discharge device as defined in claim 1 in which said liquid cleaner supply tube connects into said continaer at the bottom of said container and extends to said liquid flow means.

5. In an air regulated cleaner discharge device as defined in claim 1 in which said outlet end of said air supply tube is connected opening into said container near the upper extremity thereof with said inlet end extending downwardly and spaced above said minimum water level; and in which said liquid cleaner supply tube connects into said container at the bottom of said container and extends to said liquid flow means.

6. In an air regulated cleaner discharge device as defined in claim 1 in which said outlet end of said air supply tube is connected opening into said container near the upper extremity thereof; in which said inlet end of said air supply tube opens into said tank and is spaced just slightly below said maximum water level of said tank; and in which said liquid cleaner supply tube connects into said container at the bottom of said container and extends to said liquid flow means.

7. In an air regulated cleaner discharge device as defined in claim 1 in which said liquid flow means comprises a venturi formed between said liquid cleaner supply tube and said ballcock refill tube for creating said low pressure acting upon said liquid cleaner.

8. In an air regulated cleaner discharge device as defined in claim 1 in which said liquid flow means comprises a venturi formed in said ballcock refill tube near its connection to said overflow pipe and acting upon said liquid cleaner, said liquid cleaner supply tube being connected to said venturi and opening at an outlet side of said venturi.

9. In an air regulated cleaner discharge device as defined in claim 1 in which said liquid cleaner supply tube connects into said container at the bottom of said container and extends to said liquid flow means; and in which said liquid flow means comprises a venturi formed between said liquid cleaner supply tube and said ballcock refill tube for creating said low pressure acting upon said liquid cleaner.

10. In an air regulated cleaner discharge device as defined in claim 1 in which said outlet end of said air supply tube is connected opening into said container near the upper extremity thereof with said inlet end extending downwardly and spaced above said minimum water level; in which said liquid cleaner supply tube connects into said container at the bottom of said container and extends to said liquid flow means; and in which said liquid flow means comprises a venturi formed in said ballcock refill tube near its connection to said overflow pipe and acting upon said liquid cleaner, said liquid cleaner supply tube being connected to said venturi and opening at an outlet side of said venturi.

* * * * *